United States Patent [19]

Siddall

[11] Patent Number: 4,597,791

[45] Date of Patent: Jul. 1, 1986

[54] GOLD RECOVERY PROCESSES

[75] Inventor: George B. Siddall, Attadale, Australia

[73] Assignee: Bateman Engineering (International) Limited, Boksburg North, South Africa

[21] Appl. No.: 669,434

[22] Filed: Nov. 8, 1984

[30] Foreign Application Priority Data

Nov. 8, 1983 [AU] Australia ..... PG2269
Jun. 22, 1984 [AU] Australia ..... PG5642

[51] Int. Cl.[4] ..... C22B 11/00

[52] U.S. Cl. ..... 75/118 R; 75/1 R; 75/2; 423/26; 209/45; 209/155; 209/171; 209/175; 209/178

[58] Field of Search ..... 75/118 R, 2, 1 R; 423/26; 209/45, 155, 171, 175, 178

[56] References Cited

U.S. PATENT DOCUMENTS

| | | | |
|---|---|---|---|
| 267,351 | 11/1882 | Jones et al. | 75/118 R |
| 521,899 | 6/1894 | Sutton | 75/118 R |
| 725,609 | 4/1903 | Wolfe | 209/171 |
| 771,075 | 9/1904 | Kendall | 209/171 |
| 1,288,121 | 12/1918 | Morse | 75/2 |
| 1,519,396 | 12/1924 | Darrow | 75/2 |
| 2,186,779 | 1/1940 | Crawford | 75/2 |
| 2,315,187 | 3/1943 | Chapman et al. | 75/2 |
| 4,339,042 | 7/1982 | Windle et al. | 209/171 |
| 4,404,022 | 9/1983 | Godbehere | 423/26 |
| 4,501,721 | 2/1985 | Sherman et al. | 75/2 |

FOREIGN PATENT DOCUMENTS 530793 10/1921 France .

*Primary Examiner*—John Doll
*Assistant Examiner*—Robert L. Stoll
*Attorney, Agent, or Firm*—Dennison, Meserole, Pollack & Scheiner

[57] ABSTRACT

The present invention relates to a process for the separation of gold from particulate material containing gold, which comprises introducing a hydrophobic liquid, a non-gold particulate hydrophobic bulking material and particulate, gold containing material into an aqueous liquid so that the hydrophobic liquid becomes associated with the gold and, in conjunction with the non-gold particulate hydrophobic material, forms gold bearing agglomerates bonded by the hydrophobic liquid, and separating the gold bearing agglomerates from the aqueous liquid.

8 Claims, 2 Drawing Figures

GOLD RECOVERY PROCESSES

The present invention relates to gold recovery processes. In French Pat. No. 530793 there is described a process for processing, in general, mineral substances reduced to particulate form by incorporating the particulate mineral in an aqueous slurry together with a mineral oil and a particulate - carboniferous material so as to form agglomerates containing valuable mineral particles, carboniferous material and mineral oil but excluding water and impurities of the mineral. The agglomerates are separated from the aqueous slurry and the valuable mineral particules are subsequently recovered from the agglomerates.

The present invention provides a process by which the natural affinity of gold as metal, electrum and tellurides (further described herein as gold minerals) for hydrophobic liquids such as grease and oil is utilised to achieve separation of such gold from other particulate material.

In accordance with the present invention there is provided a process for the separation of such gold from particulate material which comprises introducing a hydrophobic liquid and a non-gold particulate hydrophobic bulking material to an aqueous slurry of the particulate, gold-containing material so that the hydrophobic liquid becomes associated with such gold and, in conjunction with the non-gold particulate hydrophobic material, forms gold bearing agglomerates bonded by the hydrophobic liquid, and separating the gold bearing agglomerates from the aqueous liquid.

Figure 1:
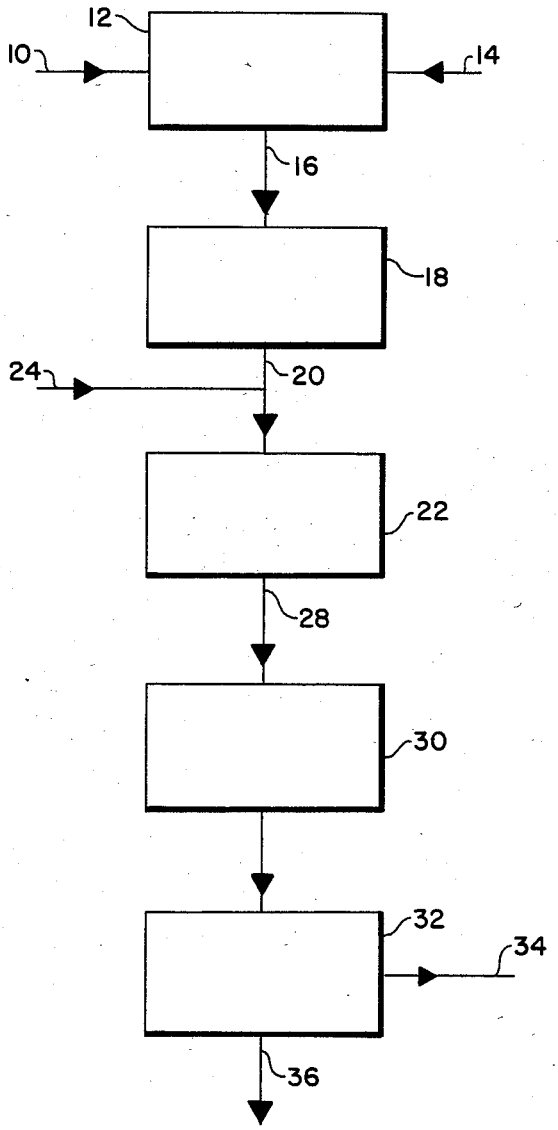
Figure 2:
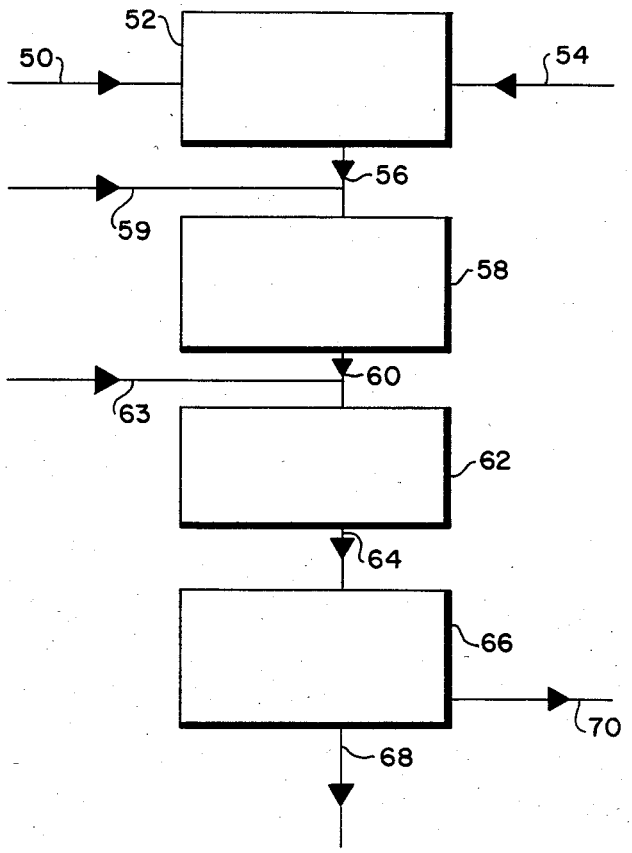

The present invention will now be described, by way of example, with reference to the accompanying drawings, in which:

FIG. 1 is a schematic flow sheet of one embodiment of the present invention; and FIG. 2 is a schematic flow sheet of another embodiment of the present invention.

With reference to FIG. 1, the gold has to be initially liberated before it can be agglomerated. Thus, if the gold is contained in ore, the ore must be first fed along a line 10 to a comminuter 12 in which is comminuted to reduce it to particulate form. For the treatment of tailings dumps or eluvial or alluvial deposits, no comminution may be necessary as the material is generally already in particulate form. In this case the comminuter 12 can be replaced by a simple mixer.

Prior to application of the gold recovery process of the present invention, the particulate gold-containing material must first be formed into a slurry by admixture with water fed along a line 14. The slurry can then be passed via a line 16 to a trash screen 18 to remove any woodchips or plastics trash or large lumps of waste from the slurry.

The screened slurry is fed via a line 20 to a feed hopper 22.

With gold bearing materials, the amount of gold is usually very small and thus it is frequently found that insufficient mineral exists to form agglomerates of the desired size. However, it has now been found in accordance with one embodiment of the present invention that this problem can be overcome by using pre-formed agglomerates. This can be done by introducing a hydrophobic liquid such as oil into an aqueous environment together with a hydrophobic non-gold particulate solid bulking material. The bulking material is wetted by the hydrophobic liquid and the result is that the hydrophobic liquid coating extends from solid particle to solid particle so that an agglomerate is formed.

The bulking solid may be carbon, polystyrene, ground coal, ground lignite, polyethylene, or other hydrophobic materials.

The pre-formed agglomerates may be stored until required for use in the gold recovery process of the present invention.

In the process of FIG. 1 a pump is provided downstream of the feed hopper 22 into which the slurry containing gold bearing particulate material is fed. The feed hopper 22 acts as a feed reservoir for this pump. This pump may be an ordinary slurry pump suitable for handling coarse solids.

The pre-formed agglomerates may be introduced into the feed hopper via a line 24.

The pre-formed agglomerates and the slurry of particulate gold containing material are then pumped via a line 28 from the feed hopper 22 into a contactor 30 such as a pipe, a stirred tank or other form of contactor which is of sufficient size to accommodate the desired amount of material for a suitable residence time for formation of gold bearing agglomerates. The type of pipe used is not critical but it is preferred to use a pipe with a degree of internal surface roughness as is known in the art, so as to promote turbulence and saltation of agglomerates during passage along the pipe since this promotes their formation and growth. Preferably, the pipe is formed of a non-hydrophobic material to reduce the tendency of hydrophobic liquid to adhere to the wall of the pipe.

The gold bearing agglomerates can then be recovered from the aqueous slurry by conventional mineral processing techniques such as screening at 32. Agglomerates are removed for gold recovery via a line 34, while the barren slurry is removed via a line 36.

The preferred residence time of the slurry in the contactor is in the order of magnitude of 2 minutes and the preferred slurry in the pipe contactor is in the order of 1–3 meters/second.

Agglomeration can be controlled in the pipe by controlling the extent of turbulence. This may be achieved by using a pipe with a selected degree of internal roughness. In the embodiment of the invention using a pipe line, the pre-formed agglomerates and the aqueous slurry together through the apparatus.

Thus, the embodiment of the present invention is a co-current process.

However, this embodiment of the present invention could equally well be operated in a continuously stirred vessel containing an aqueous slurry to which pre-formed agglomerates may be added as collecting substrate. The contents of the vessel would generally be stirred or agitated with a power input in the order of magnitude of 0.1 $kw/m^3$ so as to provide contact of the gold with the collecting substrate. When a desired amount of gold has been removed from the particulate gold containing material by the collecting substrate so as to form gold bearing agglomerates, the contents of the vessel can be passed over a screen to separate the gold bearing agglomerates from the aqueous liquid. It is envisaged that in this embodiment of the present invention, residence times could be in the order of magnitude of 6 minutes and that several stages may be desirable for enhanced gold recovery. Also, the process of the present invention could be carried out in a counter-current process in which the aqueous liquid and particulate gold containing material would move relative to the substrate. For example, the aqueous liquid could be caused to move in a flowing stream to which the particulate gold containing material was added and the collecting substrate in the form of pre-formed agglomerates could be restrained from movement by means of a screen or the like. In this case the collecting substrate could be held stationary or constrained within a stirred or agitated vessel by a screen and the aqueous liquid and particulate, gold containing material would move. The gold bearing agglomerates can be recovered from the screen when they have become sufficiently loaded with gold. The initial slurry of gold containing particulate material used in the present invention preferably contains in the order of magnitude of 0.2 units by weight of the particulate material per unit weight of slurry. Preferably, the concentration of the particulate material in the slurry is about 20% to 40% by weight of the slurry.

The trash screen 18 is preferably set at an aperture of about 0.5 mm so that material below this particle size will pass to the feed hopper 22.

To form the pre-formed agglomerates it is preferred that the hydrophobic liquid be emulsified. Emulsification of the hydrophobic liquid results in energy savings in that the liquid needs less agitation to disperse it in the aqueous phase, and less time is required for agglomeration. The hydrophobic liquid may be emulsified by being beaten up with water in a suitable mixing device or, preferably, by the application of an emulsifying reagent.

When forming pre-formed agglomerates, the amount of hydrophobic liquid used is preferably about 5 to 25% by weight, more preferably 15 to 22% by weight, of the bulking material.

The size of the formed gold bearing agglomerate is affected by the degree of agitation with greater agitation reducing agglomerate size.

In another embodiment of the present invention the agglomerates with a non-gold particulate material can be formed simultaneously with gold minerals prior to their collection. For example, a particulate, gold-containing material and a finely divided non-gold hydrophobic bulking material could be incorporated into a body of aqueous liquid to form a slurry. At some point subsequent to the addition of the other components, a hydrophobic liquid is added to the body of the aqueous slurry. The hydrophobic liquid may be emulsified by being beaten up with water in a suitable mixing device or preferably by the application of an emulsifying reagent. The hydrophobic liquid contacts the non-gold hydrophobic bulking material and the gold containing material, forming agglomerates which contain gold right through their structure in contrast to the use of pre-formed agglomerates where the gold tends to be concentrated on the outside of the agglomerate.

A typical flow sheet for this embodiment of the present invention is shown in FIG. 2. In FIG. 2, particulate gold containing material is fed along a line 50 to a mixer 52. Water is fed along a line 54 to the mixer 52. A slurry of the gold containing material is fed from the mixer 52 along a line 56 to a further mixer 58. Prior to entry to the mixer 58, but downstream of the mixer 52, a particulate, non-gold solid bulking material is introduced into the slurry via a line 59.

A slurry containing the two particulate materials is fed via a line 60 to a contactor 62 similar to that described above in relation to FIG. 1. Prior to entry to the contactor 62 a quantity of hydrophobic liquid, preferably emulsified, is added to the slurry via a line 63. As described above in relation to FIG. 1, the materials in the aqueous liquid are agitated so as to cause the hydrophobic liquid to form agglomerates with the aid of the bulking material, and to simultaneously incorporate gold into the agglomerates. The aqueous liquid containing agglomerates is then passed via a line 64 to a recovery device 66 such as a screen. Agglomerates are removed for gold recovery via a line 68, whilst the barren slurry is removed via a line 70.

The process of the present invention can be used with gold particles having a wide range of sizes such as from 0.2 to 200 micrometers. Also, the process does not require a high capital cost plant to operate it, and the energy demand is low, so reducing operating costs. Environmental problems associated with the process of the present invention are low since it avoids the use of highly toxic materials such as cyanide and mercury.

I claim:

1. A process for the separation of gold from particulate material containing gold, comprising the steps of:

(a) introducing a hydrophobic liquid and a non-gold particulate hydrophobic bulking material into an aqueous environment so as to pre-form agglomerates containing said bulking material;

(b) introducing said pre-formed agglomerates and said particulate material containing gold into an aqueous liquid, so that the agglomerates contact the gold to form gold bearing agglomerates; and (c) separating the gold bearing agglomerate from the aqueous liquid.

2. A process according to claim 1, in which the pre-formed agglomerates and the particulate material containing gold are introduced into a flowing stream of aqueous liquid and the gold bearing agglomerates are formed in the flowing stream of aqueous liquid.

3. A process according to claim 1, in which the amount of hydrophobic liquid used to form the pre-formed agglomerates is about 5 to 25% by weight of the non-gold particulate bulking material.

4. A process according to claim 1, in which the amount of hydrophobic liquid used to form the pre-formed agglomerates is about 15 to 22% by weight of the non-gold particulate bulking material.

5. A process according to claim 1, in which between 20 and 30 grams of pre-formed agglomerate is used per liter of aqueous liquid.

6. A process according to claim 1, in which the hydrophobic liquid is emulsified prior to addition to the aqueous environment.

7. A process according to claim 1, in which aqueous environment contains an emulsifying agent.

8. A process according to claim 1, in which the hydrophobic liquid which is introduced contains an emulsifying agent.

* * * * *